US012623141B1

(12) United States Patent
Li

(10) Patent No.: US 12,623,141 B1
(45) Date of Patent: May 12, 2026

(54) FINGER BATTLE TOY

(71) Applicant: Shenzhen Beipengxing Technology Co., Ltd, Shenzhen (CN)

(72) Inventor: Lifang Li, Shenzhen (CN)

( * ) Notice: Subject to any disclaimer, the term of this patent is extended or adjusted under 35 U.S.C. 154(b) by 0 days.

(21) Appl. No.: 19/444,755

(22) Filed: Jan. 9, 2026

(30) Foreign Application Priority Data

Aug. 19, 2025 (CN) ..... 202521769196.0

(51) Int. Cl.
*A63F 9/24* (2006.01)

(52) U.S. Cl.
CPC ..... *A63F 9/24* (2013.01); *A63F 2009/2408* (2013.01); *A63F 2009/2442* (2013.01); *A63F 2009/2452* (2013.01); *A63F 2009/2454* (2013.01); *A63F 2009/2472* (2013.01); *A63F 2009/2479* (2013.01); *A63F 2250/492* (2013.01)

(58) Field of Classification Search
CPC ..... A63F 9/24; A63F 2009/2408; A63F 2009/2442; A63F 2009/2452; A63F 2009/2454; A63F 2009/2472; A63F 2009/2479; A63F 2250/492
See application file for complete search history.

(56) References Cited

U.S. PATENT DOCUMENTS 11,883,752 B1 * 1/2024 Chichester ..... A63F 9/001
2003/0065282 A1 * 4/2003 Demrose ..... A63B 21/4019 602/61
2005/0052412 A1 * 3/2005 McRae ..... A63F 13/24 345/158
2009/0286451 A1 * 11/2009 Bar-Hen ..... A63H 3/14 446/327

FOREIGN PATENT DOCUMENTS

GB 2507461 A * 5/2014 ..... A63F 11/0051
IN 202211017306 A * 2/2024

* cited by examiner

*Primary Examiner* — Peter J Iannuzzi
(74) *Attorney, Agent, or Firm* — Daniel M. Cohn; Howard M. Cohn

(57) ABSTRACT

A finger battle toy includes a toy body defining a pressing sensing area. The pressing sensing area is configured for a player to press a finger of another player thereon. A control circuit board, a touch detection assembly, a prompting assembly and a power supply are disposed in the toy body. The touch detection assembly, the prompting assembly and the power supply are electrically connected to the control circuit board. The power supply powers the control circuit board, the touch detection assembly and the prompting assembly. The touch detection assembly is disposed below the pressing sensing area and is configured to output a changing electrical signal to the control circuit board when the pressing sensing area is pressed. The control circuit board triggers the prompting assembly to output a prompt signal when the changing electrical signal are continuously detected for a first predetermined duration.

11 Claims, 14 Drawing Sheets

FINGER BATTLE TOY

TECHNICAL FIELD

The present disclosure relates to a technical field of toys, and in particular to a finger battle toy.

BACKGROUND

Thumb wrestling (also known as thumb battle, thumb war or knuckle battle) is a two-player competitive game. A participant needs to use a specific prop to pin down his/her opponent's thumb and maintain a position for a predetermined duration (usually judged by a winner announcing "1, 2, 3, 4, I won the thumb war"). However, conventional thumb battle props have overly simple structures and lack effective prop-player interaction mechanisms, resulting in a monotonous game experience and limited entertainment value.

SUMMARY

In view of defects in the prior art, the present disclosure provides a finger battle toy, which solves a problem that conventional thumb battle props feature a monotonous game experience and limited entertainment value.

The finger battle toy comprises a toy body defining a pressing sensing area. The pressing sensing area is configured for a first player to press a finger of a second player thereon. A control circuit board, a touch detection assembly, a prompting assembly and a power supply are disposed in the toy body. The touch detection assembly, the prompting assembly and the power supply are electrically connected to the control circuit board. The power supply powers the control circuit board, the touch detection assembly and the prompting assembly. The touch detection assembly is disposed below the pressing sensing area and is configured to output changing electrical signal to the control circuit board when the pressing sensing area is pressed. The control circuit board is configured to trigger the prompting assembly to output a prompt signal when the changing electrical signal is continuously detected for a first predetermined duration.

In some embodiments, the toy body comprises a first housing. The first housing comprises a base and an upper cover. The base comprises a first accommodating cavity. The upper cover is fastened to the first accommodating cavity. The pressing sensing area is formed on a top portion of the upper cover. The control circuit board and the touch detection assembly are disposed in the first accommodating cavity. The touch detection assembly is attached to an inner side of the top portion of the upper cover.

In some embodiments, a first through hole and a second through hole are formed on two sides of the first accommodating cavity of the base. The first through hole and the second through hole penetrate through the base in a vertical direction. Each of the first through hole and the second through hole is configured for a finger of any player to pass through.

In some embodiments, a sensing element of the touch detection assembly is a sensing copper sheet.

In some embodiments, the prompting assembly comprises one or more of a vibration module, a light-emitting module, and an audio output module.

In some embodiments, the prompting assembly comprises the vibration module, the vibration module is a vibration motor, and the prompt signal comprises vibration. The control circuit board is configured to control the vibration motor to continuously vibrate for a second predetermined duration when the changing electrical signal is continuously detected for the first predetermined duration.

In some embodiments, the prompting assembly comprises the light-emitting module, the light-emitting module comprises LED lamp beads, and the prompt signal comprises light. The first housing is a square housing. Transparent columns are respectively disposed on four corners of a top portion of the square housing. The transparent columns are hollow. An interior of each of the transparent columns is communicated with the first accommodating cavity. The LED lamp beads are respectively disposed inside the transparent columns. The LED lamp beads are electrically connected to the control circuit board. The control circuit board is configured to control the LED lamp beads to continuously emit light for a third predetermined duration when the changing electrical signal is continuously detected for the first predetermined duration.

In some embodiments, the prompting assembly comprises the audio output module. The audio output module is one or more of a loudspeaker and a buzzer, and the prompt signal comprises sound. The control circuit board is configured to control the audio output module to continuously produce the sound for a fourth predetermined duration when the changing electrical signal is continuously detected for the first predetermined duration. Sound outlet holes are defined on a position on the base corresponding to the audio output module.

In some embodiments, the toy body further comprises a second housing. The second housing defines a second accommodating cavity therein. The power supply is disposed in the second accommodating cavity. A connecting structure is disposed on a bottom portion of the first housing. The second housing is detachably connected to the first housing through the connecting structure.

In some embodiments, at least one first locking portion is disposed in the connecting structure. At least one second locking portion is disposed on an upper portion of the second housing. The at least one first locking portion is one of a protrusion and a sliding groove, and the at least one second locking portion is the other one of the protrusion and the sliding groove. When the second housing is inserted into the connecting structure, and the second housing is in a first position, the at least one second locking portion is aligned with the at least one first locking portion. When the second housing is rotated to a second position, the at least one second locking portion is locked with the at least one first locking portion to fix the second housing to the first housing.

In some embodiments, a conductive sheet is disposed on the pressing sensing area. The conductive sheet is electrically connected to the control circuit board to enable a current to flow through the conductive sheet.

In the embodiments of the present disclosure, an electronic control circuit is formed in the toy body. The electronic control circuit comprises the control circuit board, the touch detection assembly, the prompting assembly, and the power supply. During a game, when the first player presses the finger of the second player on the pressing sensing area of the toy body, the touch detection assembly is triggered to output the changing electrical signal to the control circuit board. When the finger remains pressed for at least the first predetermined duration, the control circuit board triggers the prompting assembly to output the prompt signal. The prompt signal comprises one or more of the vibration output by the vibration module, the light emitted by the light-emitting module, and the sound produced by the audio output module. The prompting assembly stops outputting the prompt signal after continuously outputting it for the second predetermined duration. Through the method, the finger battle toy provides feedback to actions of the players, achieving interaction with the players, enriching the gaming experience, and enhancing the entertainment value of the finger battle toy.

The above description is merely an overview of technical solutions of the present disclosure. In order to clearly understand technical means of the present disclosure and enable the present disclosure being implemented according to a content of the description, and in order to make the above and other objectives, features and characteristics of the present disclosure obvious and understandable, specific embodiments of the present disclosure are described below.

BRIEF DESCRIPTION OF DRAWINGS

Various characteristics and benefits will become obvious to those skilled in the art by reading the following detailed description of optional embodiments. Drawings are only for a purpose of illustrating the optional embodiments and are not considered to be limiting of the present disclosure. Moreover, in all of the drawings, the same reference symbols refer to the same components.

Figure 1:
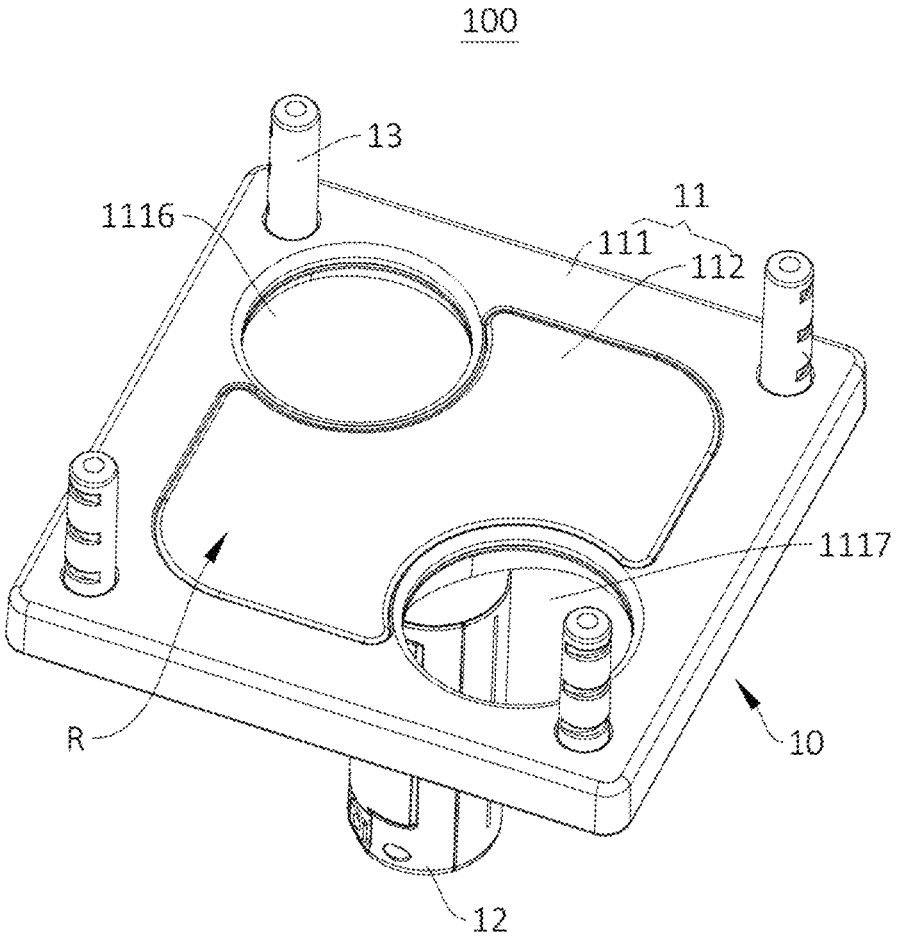
FIG. 1 is a schematic diagram of a finger battle toy according to one embodiment of the present disclosure.

In the drawings: 100—Finger-playing toy; 10—toy body; 11—first housing; 111—base; 1111—first accommodating cavity; 1112—locking groove; 1113—first groove; 1114—second groove; 1115—third groove; 1116—first through hole; 1117—second through hole; 1118—sound outlet hole; 112—top cover; 113—connecting structure; 1131—first locking portion; 1132—positioning groove; 1121—hook; 12—second housing; 121—second accommodating cavity; 122—second locking portion; 1221—locking block; 1222—positioning block 13—column; R—pressing sensing area; 20—control circuit board; 30—touch detection assembly; 40—prompting assembly; 41—vibration module; 42—light-emitting module; 43—audio output module; 50—power supply; 51—power switch.

DETAILED DESCRIPTION

Embodiments of technical solutions of the present disclosure are described in detail below with reference to the accompanying drawings. The following embodiments are only used to clearly illustrate the technical solutions of the present disclosure, and therefore are only used as examples, and cannot be used to limit the protection scope of the present disclosure.

Unless otherwise defined, all technical and scientific terms used herein have the same meaning as commonly understood by those skilled in the art of the present disclosure. The terms used in the description of the present disclosure herein are only for the purpose of describing specific embodiments, and are not intended to limit the present disclosure. In the present disclosure, terms "include", "comprise", "have", and any variations thereof are intended to cover non-exclusive inclusion.

In the description of the embodiments of the present disclosure, the technical terms "first", "second", etc. are merely used for distinguishing different objects, and cannot be understood as indicating or implying relative importance or implicitly indicating the number, specific order, or primary and secondary relationships of the indicated technical features. In the description of the embodiments of the present disclosure, "a plurality of" means more than two, unless otherwise specifically defined.

Reference herein to "embodiment" means that a particular feature, structure, or characteristic described in connection with one embodiment may be comprised in at least one embodiment of the present disclosure. The appearances of the "embodiment" in various positions in the specification are not necessarily referring to the same embodiment, and are not independent or alternative embodiments mutually exclusive of other embodiments. Those skilled in the art explicitly and implicitly understand that the embodiments described herein may be combined with other embodiments.

In the description of the embodiments of the present disclosure, the term "and/or" is merely an association relationship describing associated objects, representing any combination of listed objects. For example, "A and/or B" may indicate A exists alone, A and B exist at the same time, and B exists alone. The character "/" generally indicates that the associated object is alternative.

In addition, terms such as "central", "lateral", "longitudinal", "length", "width", "thickness", "upper", "lower", "left", "right", "vertical", "horizontal", "top", "bottom", "inner", "outer", "clockwise", "counterclockwise", "axial", "radial", etc. indicate direction or position relationships shown based on the drawings, and are only intended to facilitate the description of the present disclosure and the simplification of the description rather than to indicate or imply that the indicated device or element must have a specific direction or constructed and operated in a specific direction, and therefore, shall not be understood as a limitation to the present disclosure.

It should be noted in the description of the present disclosure that, unless otherwise regulated and defined, terms such as "installation," "bonded," and "connection" shall be understood in a broad sense, and for example, may refer to fixed connection or detachable connection or integral connection; may refer to mechanical connection or electrical connection; and may refer to direct connection or indirect connection through an intermediate medium or inner communication of two elements. For those of ordinary skill in the art, the meanings of the above terms in the present disclosure may be understood according to concrete conditions.

The present disclosure provides a finger battle toy. In the present disclosure, an electronic control circuit is formed in a toy body. The electronic control circuit comprises a control circuit board, a touch detection assembly, a prompting assembly, and a power supply. During a game, when a first player presses a finger of a second player on a pressing sensing area of the toy body, the touch detection assembly is triggered to output a changing electrical signal to the control circuit board. When the finger remains pressed for at least a first predetermined duration, the control circuit board triggers the prompting assembly to output a prompt signal. The prompt signal comprises one or more of vibration output by the vibration module, light emitted by the light-emitting module, and sound produced by the audio output module. The prompting assembly stops outputting the prompt signal after continuously outputting it for a second predetermined duration. Through the method, the finger battle toy provides feedback to actions of the players, achieving interaction with the players, enriching the gaming experience, and enhancing the entertainment value of the finger battle toy.

Figure 2:
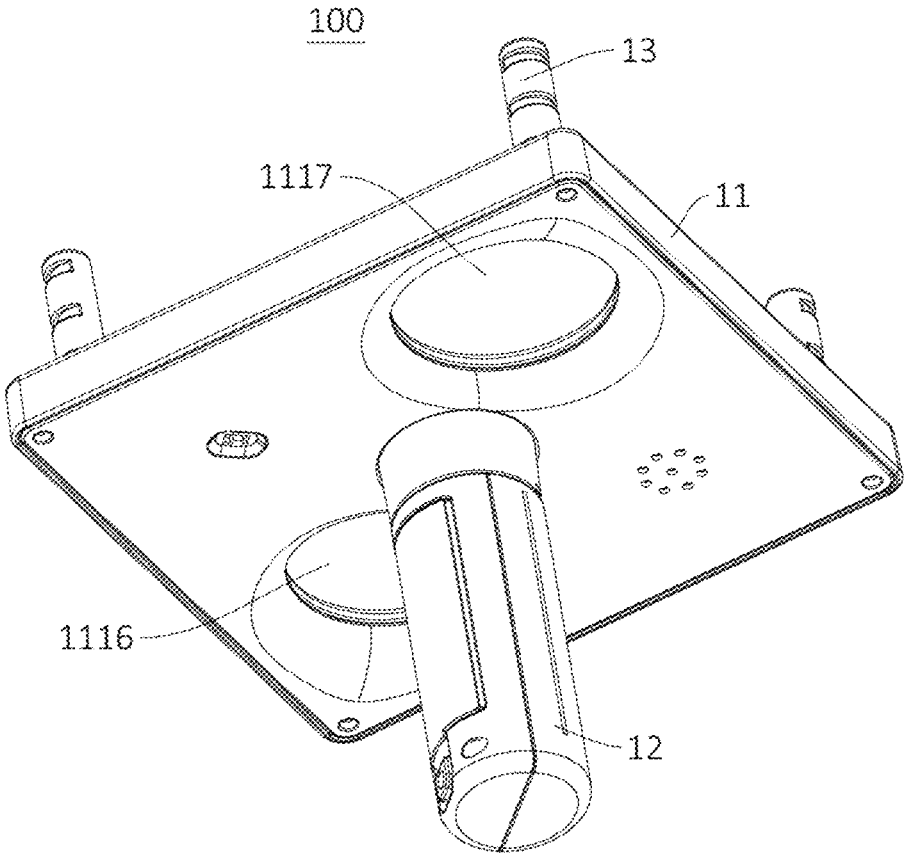
FIG. 2 is another schematic diagram of the finger battle toy according to one embodiment of the present disclosure.
Figure 3:
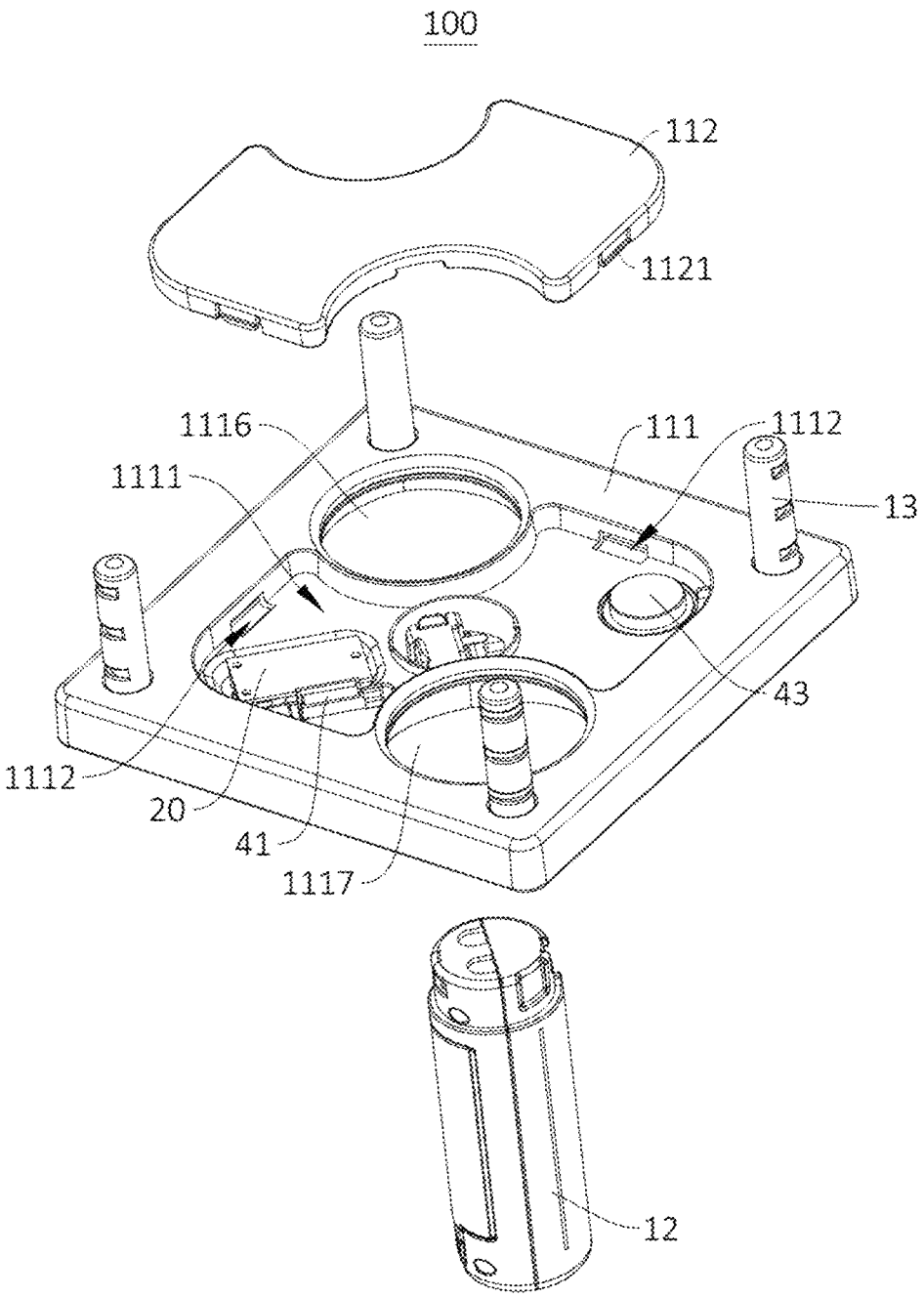
FIG. 3 is an exploded schematic diagram of the finger battle toy according to one embodiment of the present disclosure.
Figure 4:
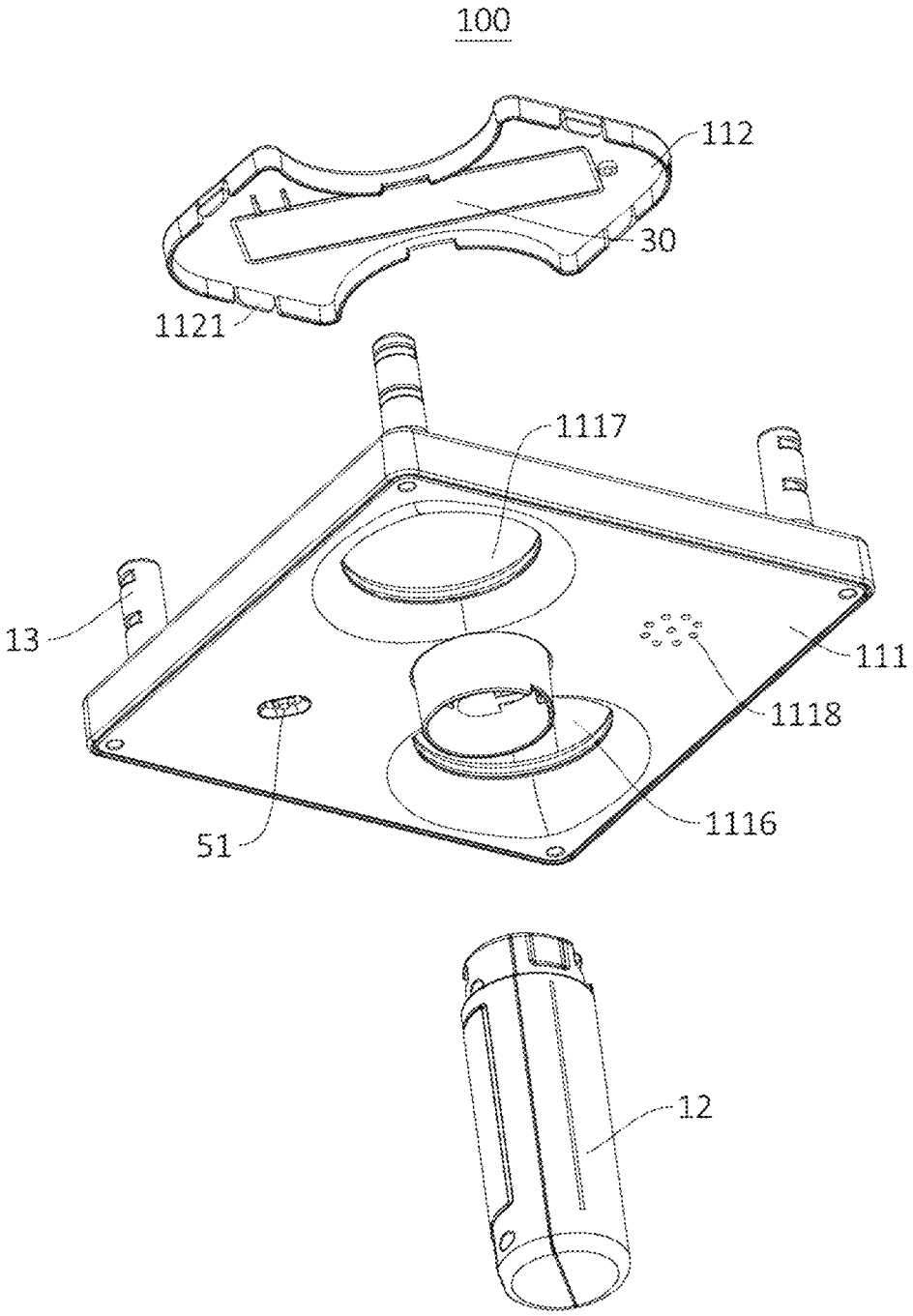
FIG. 4 is another exploded schematic diagram of the finger battle toy according to one embodiment of the present disclosure.
Figure 5:
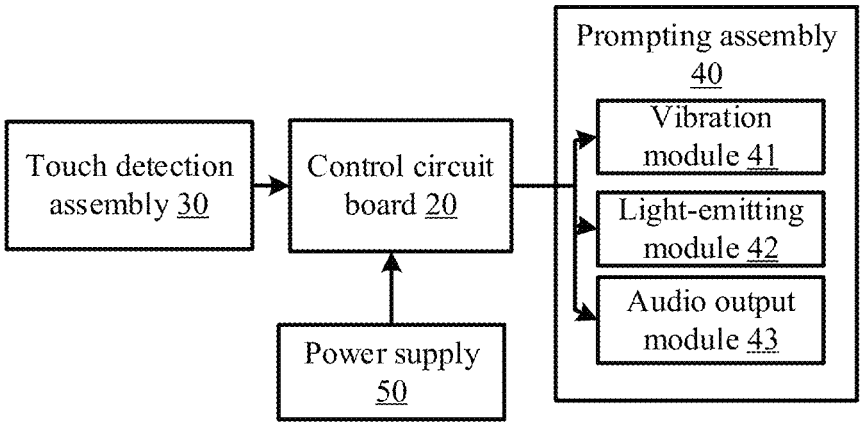
FIG. 5 is a block diagram of an electronic control circuit of the finger battle toy according to one embodiment of the present disclosure.

FIG. 1 is a schematic diagram of the finger battle toy according to one embodiment of the present disclosure. FIG. 2 is another schematic diagram of the finger battle toy according to one embodiment of the present disclosure. FIG. 3 is an exploded schematic diagram of the finger battle toy according to one embodiment of the present disclosure. FIG. 4 is another exploded schematic diagram of the finger battle toy according to one embodiment of the present disclosure. FIG. 5 is a block diagram of an electronic control circuit of the finger battle toy according to one embodiment of the present disclosure.

The finger battle toy 100 of the present disclosure is configured as a prop for thumb wrestling games, or as a prop for other finger wrestling games besides thumb.

The finger battle toy 100 comprises a toy body 10. A control circuit board 20, a touch detection assembly 30, a prompting assembly 40 and a power supply 50 are disposed in the toy body 10.

The toy body 10 comprises a first housing 11 and a second housing 12. The second housing 12 is disposed below and connected to the first housing 11. In a specific embodiment shown in the figures, the first housing 11 is square, which means that an outer contour of the first housing 11 is approximately cuboid. A cross-section of the first housing 11 is approximately square. Columns 13 are disposed at four corners of a top portion of the first housing 11, and a ring rope (e.g., an elastic ring ropes, not shown in the figures) is sleeved on the four columns 13, creating a structure resembling a boxing ring and increasing the realism and fun of a finger battle game.

The second housing 12 is detachably connected to the first housing 11, which reduces packaging volume and facilitates transportation, storage, and sales. In the specific embodiment shown in the figures, the second housing 12 is cylindrical, making the second housing easy for a user to hold when disassembling the second housing 12, thus facilitating disassembly.

In other embodiments, the first housing 11 is a cylinder, a frustum, or other shapes, and the second housing 12 is a cuboid, a frustum, or other shapes; which are not limited thereto.

As shown in FIG. 5, the touch detection assembly 30, the prompting assembly 40 and the power supply 50 are electrically connected to the control circuit board 20. The power supply 50 powers the control circuit board 20, the touch detection assembly 30 and the prompting assembly 40. An electrical connection between the control circuit board 20, the touch detection assembly 30, and the prompting assembly 40 enables an acquisition of electrical signals and a transmission of control signals, thereby realizing an electronic function of the finger-playing toy 100 of the present disclosure to provide feedback to actions of the players. The aforementioned electrical connection is realized by wires or connectors.

As shown in FIG. 1, the toy body 10 defines a pressing sensing area R. The pressing sensing area R is configured for the first player to press the finger of the second player. As shown in FIGS. 3-4, the touch detection assembly 30 is disposed below the pressing sensing area R and is configured to output changing electrical signal to the control circuit board 20 when the pressing sensing area R is pressed. The control circuit board 20 is configured to trigger the prompting assembly 40 to output a prompt signal when the changing electrical signal are continuously detected for a first predetermined duration.

Since game rules of the thumb battle game require one player to press down a thumb of an opponent and maintain the thumb at a pressed position for a predetermined duration, the game rules are established by setting the first predetermined duration. When the changing electrical signal is continuously detected for the first predetermined duration, it indicates that one of two players (e.g., the first player) has pressed the finger of the other player (e.g., the second player) onto the pressing sensing area R for at least the first predetermined duration. At this point, the first player wins, and the prompting assembly 40 outputs the prompt signal indicating that the first player has won. The first predetermined duration may be determined as 3 seconds or other duration, which is not limited thereto.

As shown in FIGS. 3-4, the first housing 11 comprises a base 111 and an upper cover 112. The base 111 comprises a first accommodating cavity 1111. The upper cover 112 is fastened to the first accommodating cavity 1111. The pressing sensing area R is formed on a top portion of the upper cover 112. The first accommodating cavity 1111 is formed in only a portion of the base 111, and a cross-section of the first accommodating cavity 1111 is less than a cross-section of the base 111. A shape of the upper cover 112 is matched with a shape of the first accommodating cavity 1111. Correspondingly, a cross-section of the upper cover 112 is less than the cross-section of the base 111.

Figure 6:
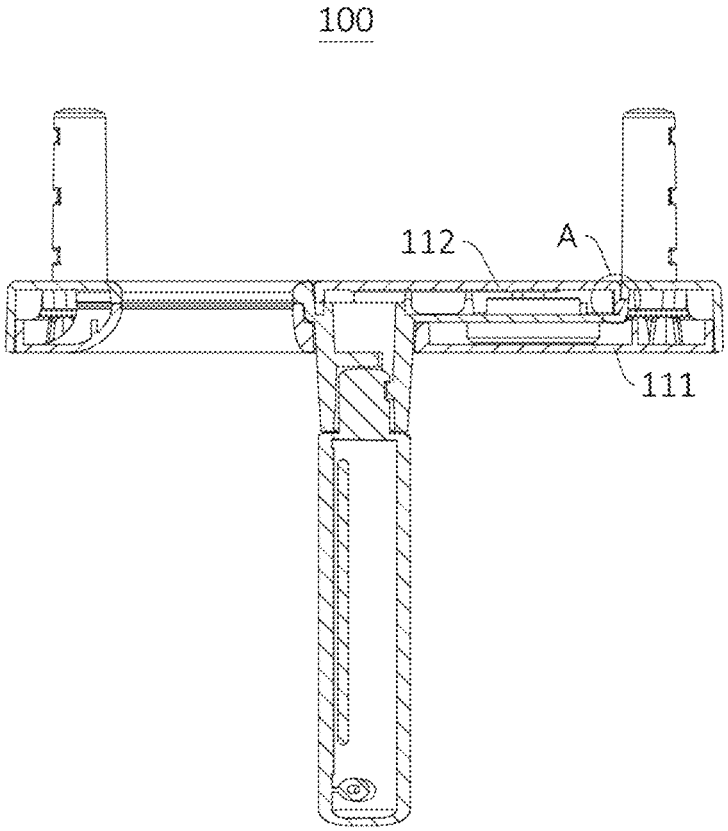
FIG. 6 is a cross-sectional schematic diagram of the finger battle toy according to one embodiment of the present disclosure.
Figure 7:
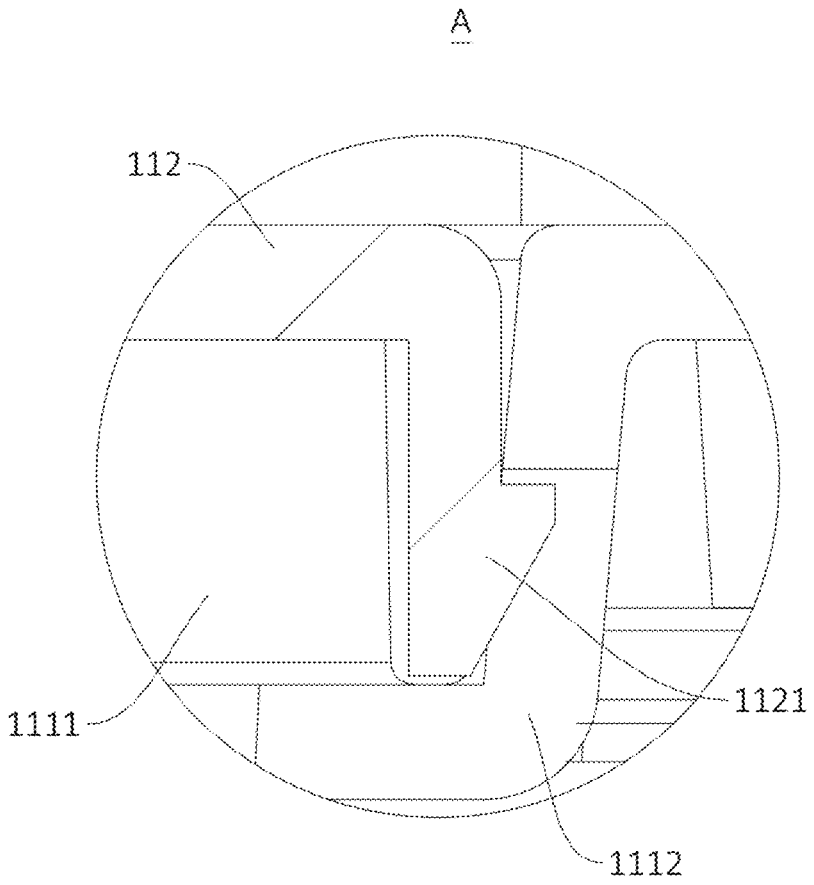
FIG. 7 is an enlarged schematic diagram of portion A shown in FIG. 6.

FIG. 6 is a cross-sectional schematic diagram of the finger battle toy according to one embodiment of the present disclosure. FIG. 7 is an enlarged schematic diagram of portion A shown in FIG. 6. As shown in FIGS. 6 and 7, at least one hook 1121 is disposed on at least one side wall of the upper cover 112. At least one hooking groove 1112 is disposed at a position, corresponding to the at least one hook, of at least one side of a bottom portion of the first accommodating cavity 1111. The at least one hook 1121 hooks into the at least one hooking groove 1112 to fasten the upper cover 112 to the base 111. In the specific embodiment shown in the figures, hooks 1121 are disposed on all four side walls of the upper cover 112, and hooking grooves 1112 are disposed on four sides of the bottom portion of the first accommodating cavity 1111. In other embodiments, the number and positions of the hooks 1121 and the hooking grooves 1112 may differ from those shown in the figures, which is not limited thereto. For example, only 2 hooks 1121 are provided, or 6 hooks 1121 are provided, etc.

Figure 8:
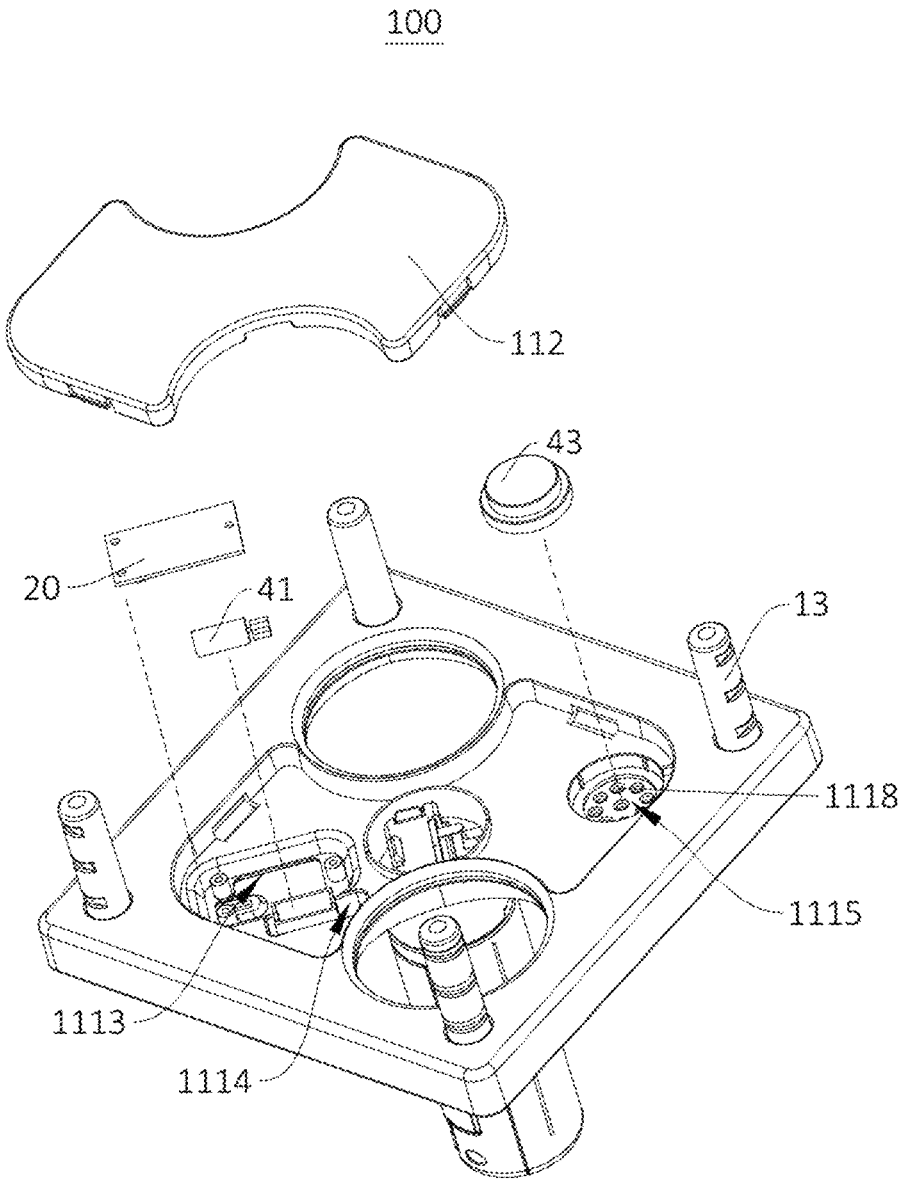
FIG. 8 is another exploded schematic diagram of the finger battle toy according to one embodiment of the present disclosure.

The control circuit board 20 and the touch detection assembly 30 are disposed in the first accommodating cavity 1111. FIG. 8 is another exploded schematic diagram of the finger battle toy according to one embodiment of the present disclosure.

As shown in FIG. 8, a first groove 1113 configured to accommodate the control circuit board 20 is formed in the bottom portion of the first accommodating cavity 1111. The first groove creates a gap between the control circuit board 20 and an inner side of the upper cover 112, preventing damage to the control circuit board 20 by compression while providing space for heat dissipation of the control circuit board 20.

The pressing sensing area R is formed on the top portion of the upper cover 112. The touch detection assembly 30 is attached to the inner side of the top portion of the upper cover 112, so that when the first player presses the finger of the second player' on the pressing sensing area R, the touch detection assembly 30 is able to detect a pressing action and output the changing electrical signal.

Figure 9:
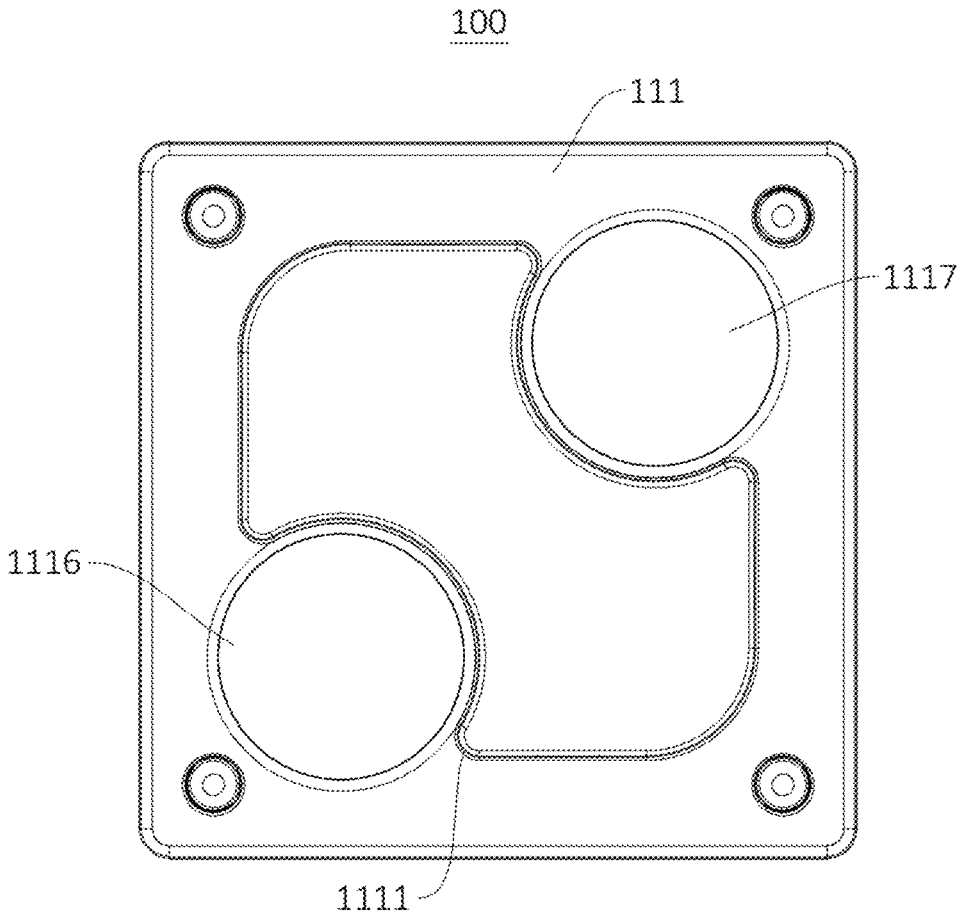
FIG. 9 is a top side schematic diagram of the finger battle toy according to one embodiment of the present disclosure.

FIG. 9 is a top side schematic diagram of the finger battle toy according to one embodiment of the present disclosure. As shown in FIGS. 1-4 and 9, a first through hole 1116 and a second through hole 1117 are formed on two sides of the first accommodating cavity 1111 of the base 111. The first through hole 1116 and the second through hole 1117 penetrate through the base 111 in a vertical direction. Each of the first through hole 1116 and the second through hole 1117 is configured for a finger of any player to pass through. For example, a thumb of the first player and a thumb of the second player respectively pass through the first through hole 1116 and the second through hole 1117 to play a thumb battle game. The first through hole 1116 and the second through hole 1117 are positioned on two sides of the first accommodating cavity 1111, and the pressing sensing area R is above the first accommodating cavity 1111, so that the thumb of any one of the two players is allowed to be pressed within the pressing sensing area R to play the thumb battle game.

Regarding electronic components of the finger battle toy 100, the touch detection assembly 30 is a capacitive touch sensor, a resistive touch sensor, a piezoelectric sensor, etc. For instance, a sensing copper sheet is configured as a sensing element of the capacitive touch sensor. In capacitive touch detection, the sensing copper sheet acts as a sensing electrode, forming a first polar plate of a capacitor. The sensing copper sheet and ground (or circuit reference ground) form an initial capacitance (parasitic capacitance). When the finger approaches, the human body acts as a second polar plate, forming a new capacitive coupling with the sensing copper sheet, changing a total capacitance. The control circuit board 20 comprises an oscillation circuit/capacitance detection integrated chip (IC) (such as TTP223 or CY8C4014) and a signal processing assembly (configured to filter and amplify signals). The control circuit board 20, electrically connected to the sensing copper sheet, is capable of sensing changing capacitance.

The control circuit board 20 further comprises a signal acquisition module and a timing trigger module. The changing electrical signal is an analog signal. The signal acquisition module, electrically connected to the touch detection assembly 30, receives the changing electrical signal, converts the changing electrical signal into a digital signal, and sends the digital signal to the timing trigger module. The timing trigger module starts timing upon receiving the digital signal and outputs a trigger signal to the prompting assembly 40 when the timing reaches the first predetermined duration. Both the signal acquisition module and the timing trigger module are components in the prior art capable of implementing the above functions.

As shown in FIGS. 3, 5, and 8, the prompting assembly 40 comprises one or more of a vibration module 41, a light-emitting module 42, and an audio output module 43. In the embodiment, the prompting assembly 40 of the finger battle toy 100 comprises the vibration module 41, the light-emitting module 42, and the audio output module 43. The vibration module 41, the light-emitting module 42, and the audio output module 43 are electrically connected to the control circuit board 20.

In the embodiment, the vibration module 41 is a vibration motor, and the prompt signal comprises vibration configured as a first part of the prompt signal. The control circuit board 20 is configured to control the vibration motor to continuously vibrate for a second predetermined duration when the changing electrical signal is continuously detected for the first predetermined duration.

The light-emitting module 42 comprises LED lamp beads, and the prompt signal comprises light configured as a second part of the prompt signal. The columns 13 respectively disposed on the four corners of the top portion of the first housing are transparent columns. The transparent columns are hollow. An interior of each of the transparent columns is communicated with the first accommodating cavity 1111. The LED lamp beads are respectively disposed inside the transparent columns. The LED lamp beads are electrically connected to the control circuit board 20. The control circuit board 20 is configured to control the LED lamp beads to continuously emit light for a third predetermined duration when the changing electrical signal is continuously detected for the first predetermined duration.

The audio output module 43 is one or more of a loudspeaker and a buzzer, and the prompt signal comprises sound configured as a third part of the prompt signal. For instance, the sound is a voice prompt such as "1, 2, 3, 4, I won the thumb war," or music indicating victory/game over. The control circuit board 20 is configured to control the audio output module 43 to continuously produce the sound for a fourth predetermined duration when the changing electrical signal is continuously detected for the first predetermined duration. For instance, the fourth predetermined duration is set to play exactly the voice prompt "1, 2, 3, 4, I won the thumb war" or exactly the music indicating victory/game over.

As shown in FIGS. 4 and 8, sound outlet holes 1118 are defined on a position on the base 111 corresponding to the audio output module 43, so that the sound emitted by the audio output module 43 is smoothly transmitted.

The second predetermined duration, the third predetermined duration, and the fourth predetermined duration maybe the same or different.

As shown in FIG. 8, a second groove 1114 and a third groove 1115 are defined on the bottom portion of the first accommodating cavity 1111. The second groove 1114 and the third groove 1115 are respectively configured to accommodate the vibration module 41 and the audio output module 43. The second groove 1114 and the third groove 1115 respectively create a gap between the vibration module 41 and the inner side of the upper cover 112 and a gap between the audio output module 43 and the inner side of the upper cover 112, thereby preventing damage from compression while providing space for heat dissipation of the vibration module 41 and the audio output module 43.

Figure 10:
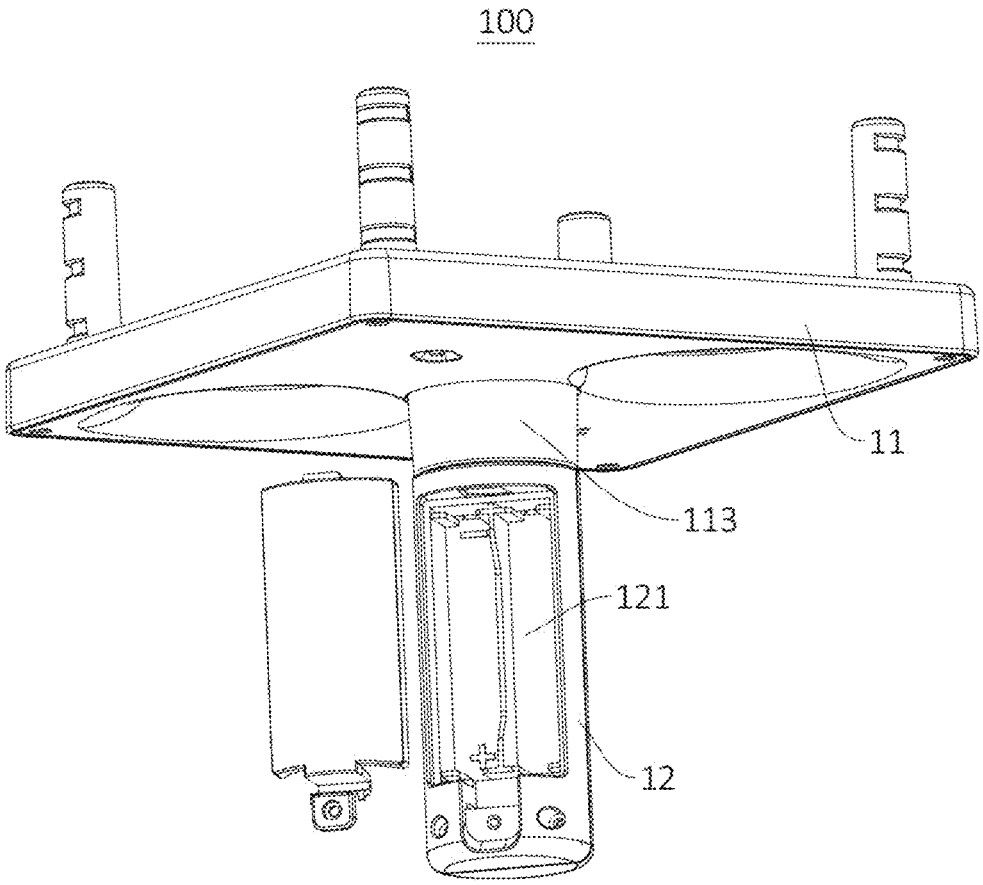
FIG. 10 is another exploded schematic diagram of the finger battle toy according to one embodiment of the present disclosure.

FIG. 10 is another exploded schematic diagram of the finger battle toy according to one embodiment of the present disclosure. As shown in FIG. 10, the second housing 12 defines a second accommodating cavity 121 therein. The power supply 50 (not shown in FIG. 10) is disposed in the second accommodating cavity 121. A connecting structure 113 is disposed on a bottom portion of the first housing 11. The second housing 12 is detachably connected to the first housing 11 through the connecting structure 113.

Figure 11:
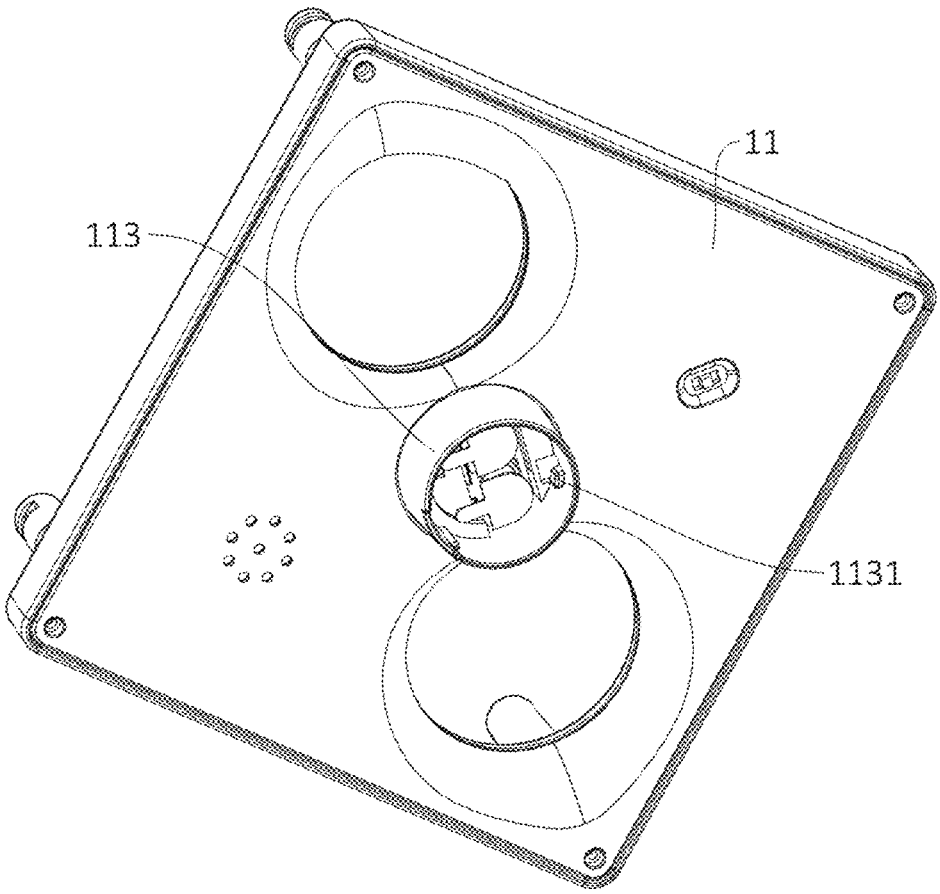
FIG. 11 is a bottom side schematic diagram of a first housing according to one embodiment of the present disclosure.
Figure 12:
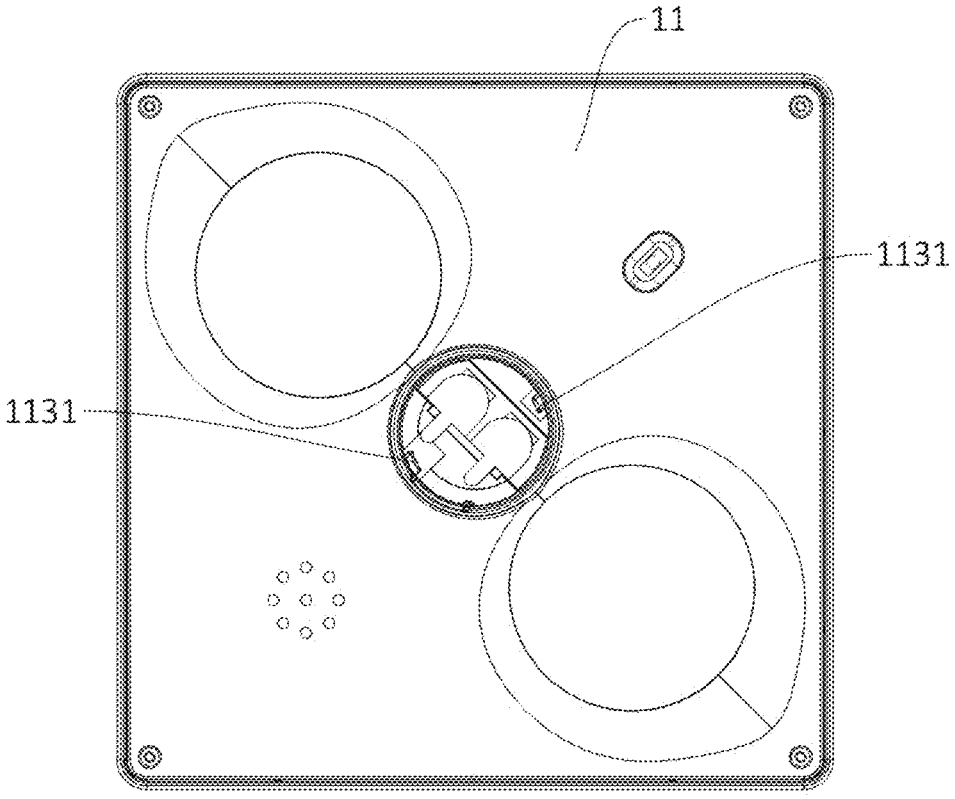
FIG. 12 is a bottom plan schematic diagram of the first housing according to one embodiment of the present disclosure.
Figure 13:
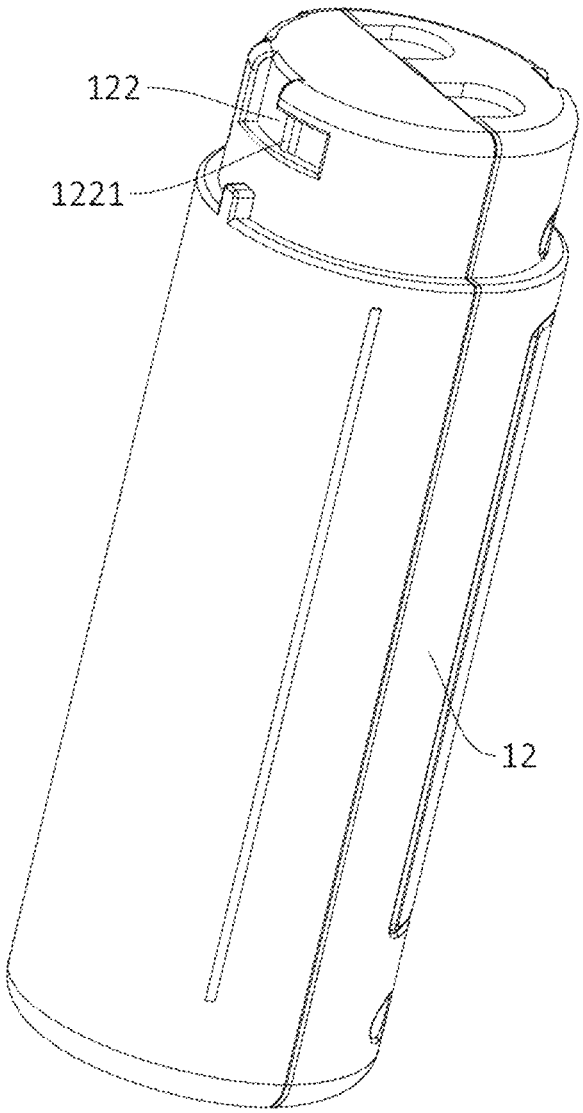
FIG. 13 is a schematic diagram of a second housing according to one embodiment of the present disclosure.
Figure 14:
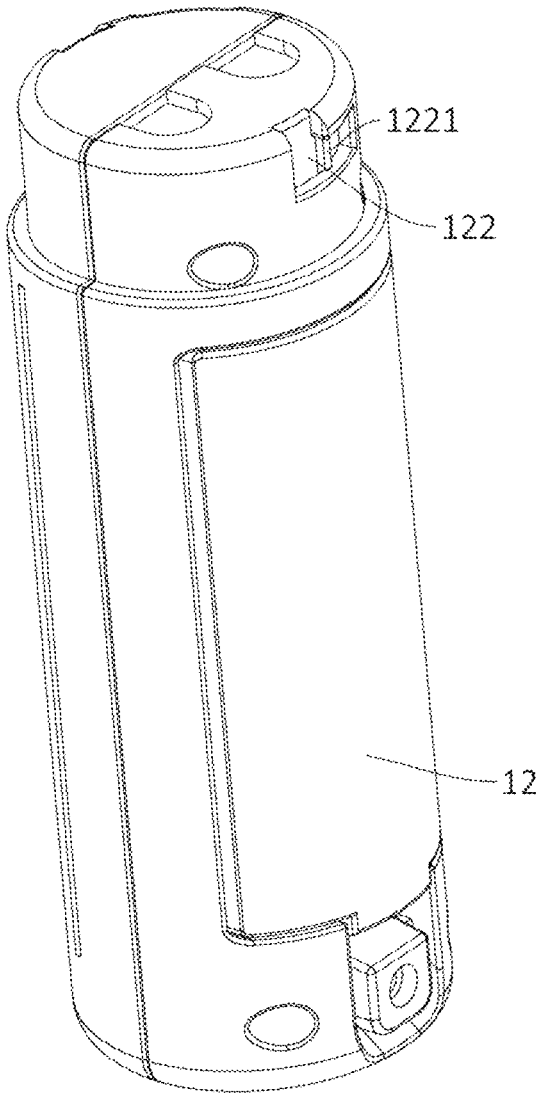
FIG. 14 is another schematic diagram of the second housing according to one embodiment of the present disclosure.
Figure 15:
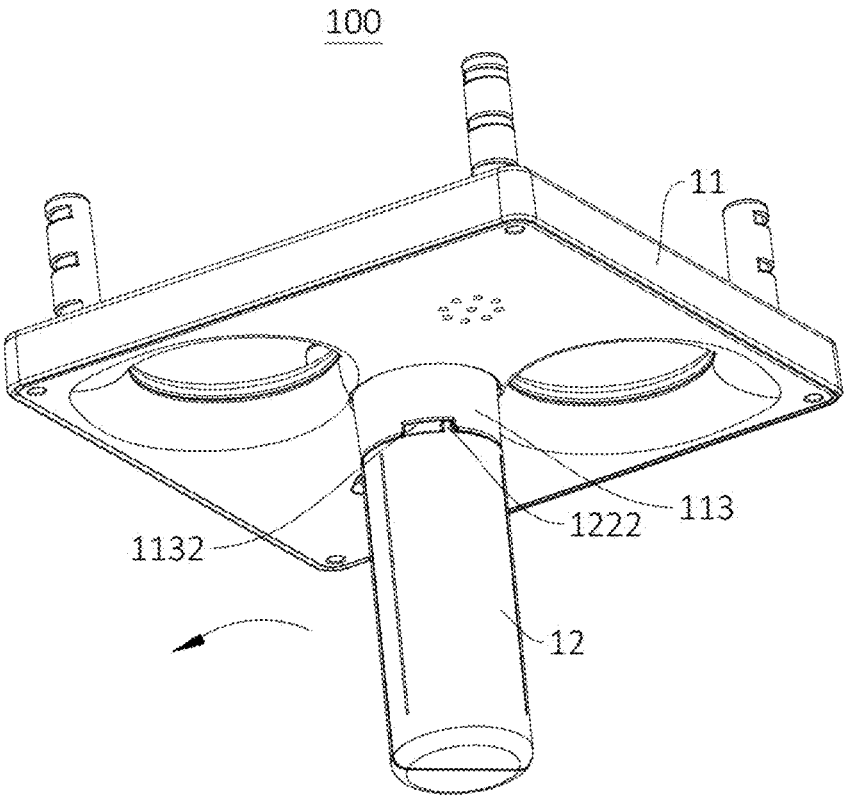
FIG. 15 is a schematic diagram of the finger battle toy according to one embodiment of the present disclosure, where the second housing is in a first position.

FIG. 11 is a bottom side schematic diagram of the first housing according to one embodiment of the present disclosure. FIG. 12 is a bottom plan schematic diagram of the first housing according to one embodiment of the present disclosure. FIG. 13 is a schematic diagram of the second housing according to one embodiment of the present disclosure. FIG. 14 is another schematic diagram of the second housing according to one embodiment of the present disclosure. FIG. 15 is a schematic diagram of the finger battle toy according to one embodiment of the present disclosure, where the second housing is in a first position.

As shown in FIGS. 11-12, at least one first locking portion 1131 is disposed in the connecting structure 113. At least one second locking portion 122 is disposed on an upper portion of the second housing 12. The at least one first locking portion 1131 is protrusion, and the at least one second locking portion 122 is a sliding groove. Specifically, the at least one second locking portion 122 is an L-shaped sliding groove. A mounting process of the second housing and the first housing is described in detail as follows. When the second housing 12 is inserted into the connecting structure 113, and the second housing 12 is in the first position (as shown in FIG. 15), the at least one second locking portion 122 is aligned with the at least one first locking portion 1131. When the second housing 12 is rotated to a second position, the at least one second locking portion 122 is locked with the at least one first locking portion 1131 to fix the second housing 12 to the first housing 11. Specifically, the protrusion of the connecting structure 113 slides from a vertical sub-groove of the L-shaped sliding groove into one end of a horizontal sub-groove of the L-shaped sliding groove. As shown in FIGS. 12 and 13. A protruding locking block 1221 is disposed in a middle portion of the horizontal sub-groove of the L-shaped sliding groove. When the second housing 12 is in the second position, the second housing 12 is blocked by the protruding locking block 1221, and the protrusion is prevented from falling laterally out of the horizontal sub-groove of the L-shaped sliding groove, thereby fixing the second housing 12 to the connecting structure 113.

The at least one locking portion comprises one or more first locking portions 1131. The at least one second locking portion comprises one or more second locking portions. In the specific embodiment shown in the figures, two first locking portions 1131 are provided; the number of the second locking portions 122 is the same as the number of first locking portions 1131. In some embodiments, each first locking portion 1131 is the sliding groove, and each second locking portion 122 is the protrusion.

When disassembling the second housing 12 from the first housing 11, the second housing 12 is rotated in an opposite direction of an arrow shown in FIG. 15 causing the first locking portions 1131 to engage from the second locking portions 122. For instance, each protrusion is moved from the horizontal sub-groove of a corresponding sliding groove e to a bottom of the vertical sub-groove. At this point, the second housing 12 is allowed to be pulled out vertically downwards.

As shown in FIG. 15, a positioning groove 1132 is defined on a lower portion of the connecting structure 113 of the first housing 11, and a positioning block 1222 corresponding to the positioning groove 1132 is disposed on the second housing 12. When mounting the second housing 12 onto the first housing 11, the positioning block 1222 is inserted into a rightmost side of the positioning groove 1132, so that the second housing 12 is in the position shown in FIG. 15. Then, the second housing 12 is rotated in a direction as the arrow in FIG. 15, so that the positioning block 1222 rotates to a leftmost side of the positioning groove 1132, thereby fixing the second housing 12 to the first housing 11.

As shown in FIG. 4, the finger battle toy 100 further comprises a power switch 51 disposed on a bottom portion of the base 111. Before starting the thumb battle game, the power switch 51 is toggled to turn on the power supply 50. After the thumb battle game, the power switch 51 is turned off to prevent accidental activation of the electronic control circuit.

A conductive sheet is disposed on the pressing sensing area R. The conductive sheet is electrically connected to the control circuit board 20 to enable a current to flow through the conductive sheet. For example, since the pressing sensing area R is formed on the top portion of the upper cover 112, the upper cover 112 is made of a conductive material (such as metal) and is electrically connected to the control circuit board 20. In other words, the upper cover 112 simultaneously functions as a cover and the conductive sheet. After the power supply 50 is turned on, the control circuit board 20 allows the current to flow through the upper cover 112. When the finger of any one of the players is pressed on the pressing sensing area R of the upper cover 112, a slight electric shock is generated, providing feedback to the actions of the players and further enhancing the user experience.

Finally, it should be noted that the above embodiments are only used to illustrate the technical solutions of the present disclosure and are not limited thereto; Although the present disclosure has been described in detail with reference to the foregoing embodiments, those skilled in the art should understand that the technical solutions described in the foregoing embodiments can still be modified, or some or all of the technical features can be equivalently replaced; and these modifications or replacements do not make the essence of the corresponding technical solutions deviate from the scope of the technical solutions of the embodiments of the present disclosure, and should all be covered in the scope of the claims and the specification of the present disclosure. In particular, the technical features mentioned in the various embodiments can be combined in any manner as long as there is no structural conflict. The present disclosure is not limited to the specific embodiments disclosed herein, but comprises all technical solutions falling within the scope of the claims.

What is claimed is:

1. A finger battle toy, comprising:

a toy body defining a pressing sensing area;

wherein the pressing sensing area is configured for a first player to press a finger of a second player thereon;

wherein a control circuit board, a touch detection assembly, a prompting assembly and a power supply are disposed in the toy body;

wherein the touch detection assembly, the prompting assembly and the power supply are electrically connected to the control circuit board, and the power supply powers the control circuit board, the touch detection assembly and the prompting assembly;

wherein the touch detection assembly is disposed below the pressing sensing area and is configured to output a changing electrical signal to the control circuit board when the pressing sensing area is pressed;

wherein the control circuit board is configured to trigger the prompting assembly to output a prompt signal when the changing electrical signal is continuously detected for a first predetermined duration.

2. The finger battle toy according to claim 1, wherein the toy body comprises a first housing, the first housing comprises a base and an upper cover, the base comprises a first accommodating cavity, and the upper cover is fastened to the first accommodating cavity;

wherein the pressing sensing area is formed on a top portion of the upper cover, the control circuit board and the touch detection assembly are disposed in the first accommodating cavity, and the touch detection assembly is attached to an inner side of the top portion of the upper cover.

3. The finger battle toy according to claim 2, wherein a first through hole and a second through hole are formed on two sides of the first accommodating cavity of the base, the first through hole and the second through hole penetrate through the base in a vertical direction, and each of the first through hole and the second through hole is configured for a finger of a corresponding player to pass through.

4. The finger battle toy according to claim 2, wherein a sensing element of the touch detection assembly is a sensing copper sheet.

5. The finger battle toy according to claim 2, wherein the prompting assembly comprises one or more of a vibration module, a light-emitting module, and an audio output module.

6. The finger battle toy according to claim 5, wherein the prompting assembly comprises the vibration module, the vibration module is a vibration motor, and the prompt signal comprises vibration;

wherein the control circuit board is configured to control the vibration motor to continuously vibrate for a second predetermined duration when the changing electrical signal is continuously detected for the first predetermined duration.

7. The finger battle toy according to claim 5, wherein the prompting assembly comprises the light-emitting module, the light-emitting module comprises LED lamp beads, and the prompt signal comprises light;

wherein the first housing is a square housing, transparent columns are respectively disposed on four corners of a top portion of the square housing, the transparent columns are hollow, and an interior of each of the transparent columns is communicated with the first accommodating cavity;

wherein the LED lamp beads are respectively disposed inside the transparent columns, the LED lamp beads are electrically connected to the control circuit board, and the control circuit board is configured to control the LED lamp beads to continuously emit light for a third predetermined duration when the changing electrical signal is continuously detected for the first predetermined duration.

8. The finger battle toy according to claim 5, wherein the prompting assembly comprises the audio output module, the audio output module is one or more of a loudspeaker and a buzzer, and the prompt signal comprises sound;

wherein the control circuit board is configured to control the audio output module to continuously produce the sound for a fourth predetermined duration when the changing electrical signal is continuously detected for the first predetermined duration;

wherein sound outlet holes are defined on a position on the base corresponding to the audio output module.

9. The finger battle toy according to claim 2, wherein the toy body further comprises a second housing, the second housing defines a second accommodating cavity therein, and the power supply is disposed in the second accommodating cavity;

wherein a connecting structure is disposed on a bottom portion of the first housing, and the second housing is detachably connected to the first housing through the connecting structure.

10. The finger battle toy according to claim 9, wherein at least one first locking portion is disposed in the connecting structure, at least one second locking portion is disposed on an upper portion of the second housing, the at least one first locking portion is one of a protrusion and a sliding groove, and the at least one second locking portion is the other one of the protrusion and the sliding groove;

wherein when the second housing is inserted into the connecting structure, and the second housing is in a first position, the at least one second locking portion is aligned with the at least one first locking portion;

wherein when the second housing is rotated to a second position, the at least one second locking portion is locked with the at least one first locking portion to fix the second housing to the first housing.

11. The finger battle toy according to claim 9, wherein a conductive sheet is disposed on the pressing sensing area, and the conductive sheet is electrically connected to the control circuit board to enable a current to flow through the conductive sheet.

* * * * *